US005350329A

United States Patent [19]

Haman

[11] Patent Number: 5,350,329

[45] Date of Patent: Sep. 27, 1994

[54] FLUSHING SYSTEM FOR OUTBOARD MOTOR

[75] Inventor: David F. Haman, Waukegan, Ill.

[73] Assignee: Outboard Marine Corporation, Waukegan, Ill.

[21] Appl. No.: 77,562

[22] Filed: Jun. 15, 1993

[51] Int. Cl.[5] ..... B63H 21/38

[52] U.S. Cl. ..... 440/88; 440/113

[58] Field of Search ..... 134/167 R, 169 A, 169 R; 440/88, 113; 251/148; 285/175, 921, 156, 305

[56] References Cited

U.S. PATENT DOCUMENTS

| | | | |
|---|---|---|---|
| 4,121,948 | 10/1978 | Guhlin | 134/169 A |
| 4,541,657 | 9/1985 | Smyth | 285/305 |
| 5,049,101 | 9/1991 | Binversie et al. | 440/88 |
| 5,199,914 | 4/1993 | Marsh | 440/88 |

OTHER PUBLICATIONS

Owner's Manual Outboard Motor BF9.9A/15A, ©Honda Motor Co., Ltd., 1987, 3 pages.

*Primary Examiner*—Sherman Basinger
*Attorney, Agent, or Firm*—Greer, Burns & Crain, Ltd.

[57] ABSTRACT

A flushing system for an outboard marine motor includes an engine provided with at least one cylinder surrounded at least partially by a cooling jacket, an access port disposed on the engine and being in fluid communication with the cooling jacket, a flushing assembly being detachably engageable in the access port for permitting inflow of a flushing fluid into the cooling jacket, and a valve member disposed on the flushing assembly for selectively controlling the inflow of flushing fluid into the cooling jacket at the discretion of an operator.

14 Claims, 2 Drawing Sheets

FLUSHING SYSTEM FOR OUTBOARD MOTOR

BACKGROUND OF THE INVENTION

The present invention relates generally to outboard marine motors having internal combustion engines or power heads, and specifically to arrangements for flushing cooling jackets of such engines, as well as other portions of the motor.

Conventional outboard motors include intakes for drawing in ambient water for cooling purposes. The intakes are generally located in a lower portion of the motor and are connected by suitable passages to the cooling jacket of the engine. A water pump is normally provided to force the water upward into the cooling jacket or galleries, and out through an outlet in the lower end of the motor.

It is recommended that, to prolong the operational life of an outboard motor, the cooling system in general, and specifically the engine cooling jacket, be periodically flushed to remove any residual contaminants. Such contaminants may become deposited on internal surfaces of the engine and motor when the motor is run in salt water or water containing corrosive pollutants. Failure to adequately flush these contaminants has been found to accelerate engine corrosion, causing premature failure and in some cases requiring the replacement of the entire power head, a costly and labor intensive operation.

Ideally, flushing is performed when the motor is out of the water, and frequently when the boat upon which the motor is mounted is located on a trailer for transport or storage. Conventional flushing systems are designed so that a common garden hose can be attached to the motor at some point to introduce a flow of fresh water into the cooling system. However, a disadvantage of many such systems is that flushing water is introduced upstream of the water pump, so that the engine must be started in order to direct the water to the cooling jacket. Running an outboard engine out of the water is often a dangerous procedure, since operators often neglect to remove the propeller, which when spinning in mid-air, may cause serious injury. Furthermore, the running of the engine out of the water is uncomfortably noisy.

A known apparatus for flushing an outboard motor without running the engine is disclosed in commonly assigned U.S. Pat. No. 5,049,101 which is incorporated by reference herein. In that apparatus, a common garden hose is connected to a flushing fluid intake fitting located on an outside of the motor cover. The fitting includes a one-way valve which is activated upon the introduction of a specified water pressure. In addition, the flushing fluid intake fitting has non-rotatable female threads to improve its aesthetic appearance.

One disadvantage of the system disclosed in the U.S. Pat. No. 5,049,101 patent is that the operator must make several trips between the location of the motor and the water spigot or tap to control the flushing operation, thus making the flushing operation tedious and frustrating. Discouraged operators may then neglect to flush their motors, thus promoting corrosion.

Another disadvantage of the above-identified prior art flushing system is that the location of the hose attachment fitting on the outside of the motor cover detracts from the overall aesthetic appearance of the motor. Current outboard motor design favors a streamlined, unobstructed profile.

Still another disadvantage of the prior art flushing system is that the use of a fitting having non-rotatable female threads requires an awkward twisting of the hose during coupling.

Thus, it is a first object of the present invention to provide an outboard marine engine having a flushing system which directs flushing fluid to the engine without requiring the starting of the engine.

Another object of the present invention is to provide an outboard engine having a flushing system which is easily connectable to a common garden hose for the source of flushing water without requiring excessive twisting of the hose.

Yet another object of the present invention is to provide a flushing system for an outboard marine motor wherein the operator has control over the flushing water flow at the engine.

Still another object of the present invention is to provide a flushing system for an outboard motor which when not in use is detachable from the engine, and wherein the flushing fluid inlet is hidden by the motor covers when not in use to enhance the overall aesthetic appearance of the motor.

SUMMARY OF THE INVENTION

The above-identified objects are met or exceeded by the present flushing system for an outboard motor having a power head or engine. A removable flushing adapter combination is engageable directly on the engine in fluid communication with the cooling jacket. The adapter combination includes a flushing adapter and a valve adapter for controlling the flow of flushing fluid at the engine. The valve adapter has a female threaded hose connection and is rotatable relative to the flushing adapter to facilitate attachment of a common garden hose. When not in use, the present flushing system is removed from the engine, and a flushing inlet port is covered by the motor cover.

More specifically, a flushing system for an outboard marine motor having an engine provided with at least one cylinder surrounded at least partially by a cooling jacket, includes an access port disposed on the engine and in fluid communication with the cooling jacket, and a flushing assembly is detachably engageable in the access port for permitting inflow of a flushing fluid into the cooling jacket. In the preferred embodiment, a valve member is disposed on the flushing assembly for selectively controlling the inflow of flushing fluid into the cooling jacket at the discretion of an operator.

In another embodiment, an outboard marine motor includes a power head configured with at least one cylinder surrounded at least partially by a cooling jacket, the power head defining at least one ambient opening into the cooling jacket, an access port disposed on the power head and being in fluid communication with said cooling jacket, a flushing assembly being detachably engageable in the access port for permitting inflow of a flushing fluid into the cooling jacket, and a motor cover for removably covering the access port when the flushing assembly is detached from the access port.

DETAILED DESCRIPTION OF THE PREFERRED EMBODIMENT

Figure 1:
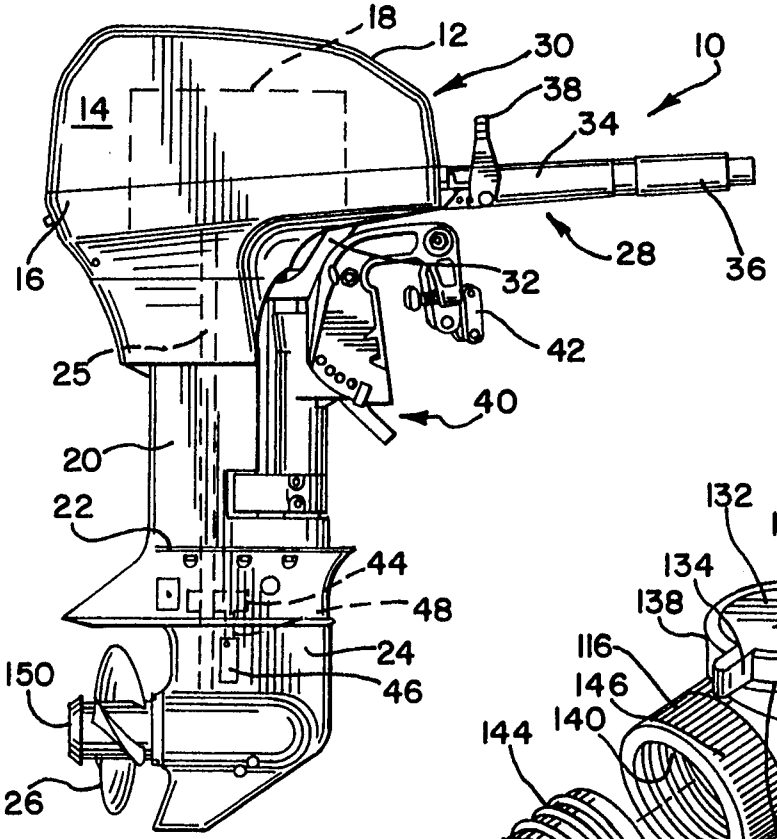
FIG. 1 is a side elevational view of an outboard motor of the type for which the present invention is intended.

Referring now to FIG. 1, an outboard motor is shown and generally designated 10. The motor 10 is provided with a motor cowl 12 which includes an upper motor cover 14 and a lower motor cover 16, the lower motor cover being provided in two parts. The lower motor cover 16, and the upper motor cover 14 are configured to meet and enclose an internal combustion engine or power head 18 (shown hidden in FIG. 1).

An exhaust housing 20 depends from the engine 18 and is attached at a lower end 22 to a gear case housing 24. The engine 18 is connected to the gear case housing 24 by a drive shaft 25 (shown hidden). A propeller 26 is provided at a lower rear portion of the gear case housing 24 and is connected thereto for propelling a boat through water under power from the engine 18, as is well known.

A steering handle assembly 28 is located at a front end 30 of the motor 10. The steering handle assembly 28 includes a steering arm or bracket 32, a tiller handle 34, an axially rotatable throttle grip 36, and a gear shift lever 38.

A stern bracket assembly 40 permits the motor 10 to be pivotally controlled by the steering assembly 28 for steering purposes. The bracket assembly 40 includes at least one and preferably two threaded transom clamp members 42 for securing the bracket assembly 40 to the stern of a boat as is well known.

A water pump 44 (shown hidden) is drivingly connected to the drive shaft 25 and draws ambient water through a screen water intake 46 located adjacent the lower end 22 of the exhaust housing 20. The cooling water is pumped by the water pump 44 from the intake conduit 48 to a cooling jacket 50 (best seen in FIG. 2) which forms a portion of the engine 18. Extending between the cooling jacket 50 and the lower end 22 are appropriate conduits (not shown) for both conveying coolant to, and discharging the coolant from the cooling jacket 50, as is known in the art.

Figure 3:
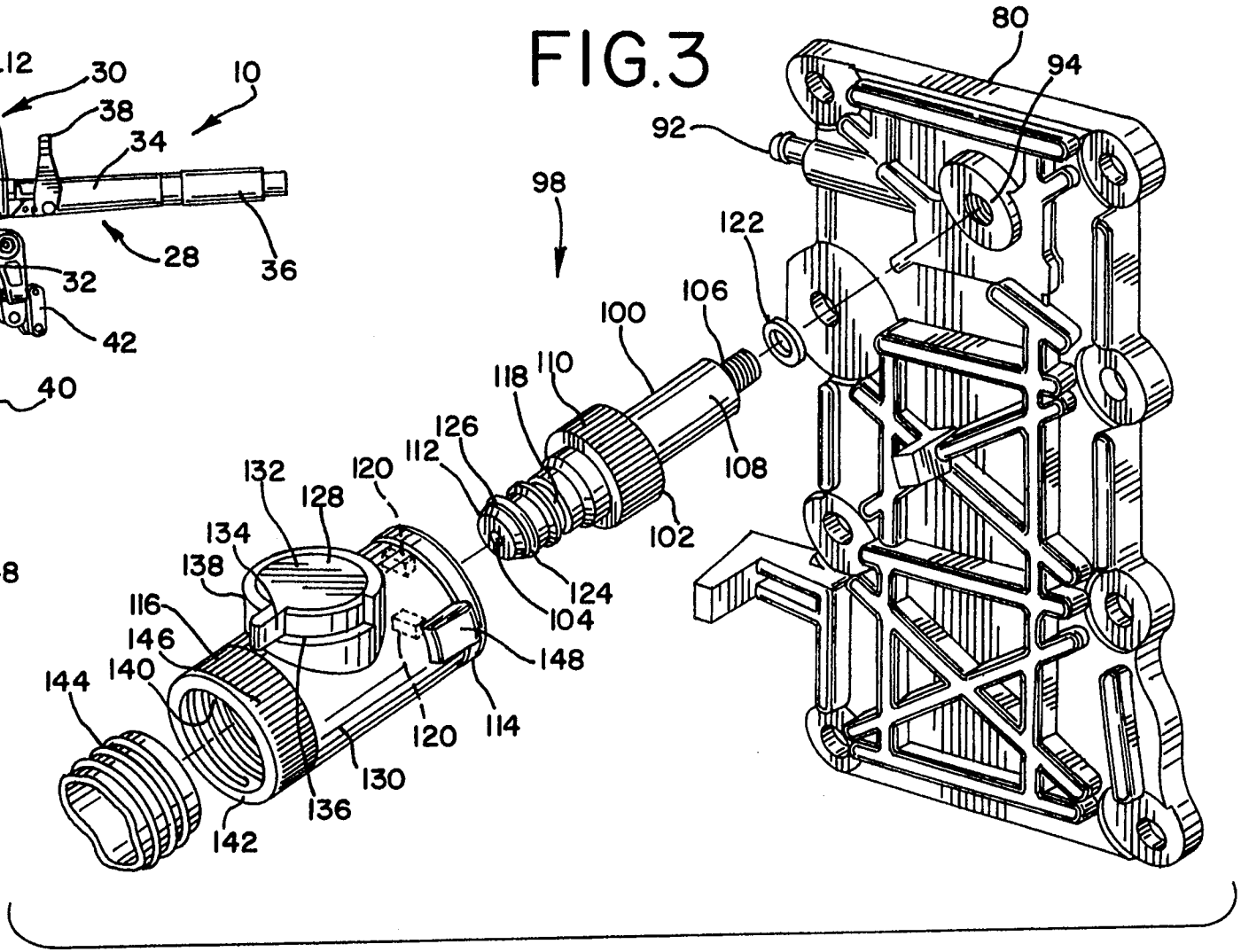
FIG. 3 is an enlarged exploded perspective elevational view of the flushing system of the invention.
Figure 2:
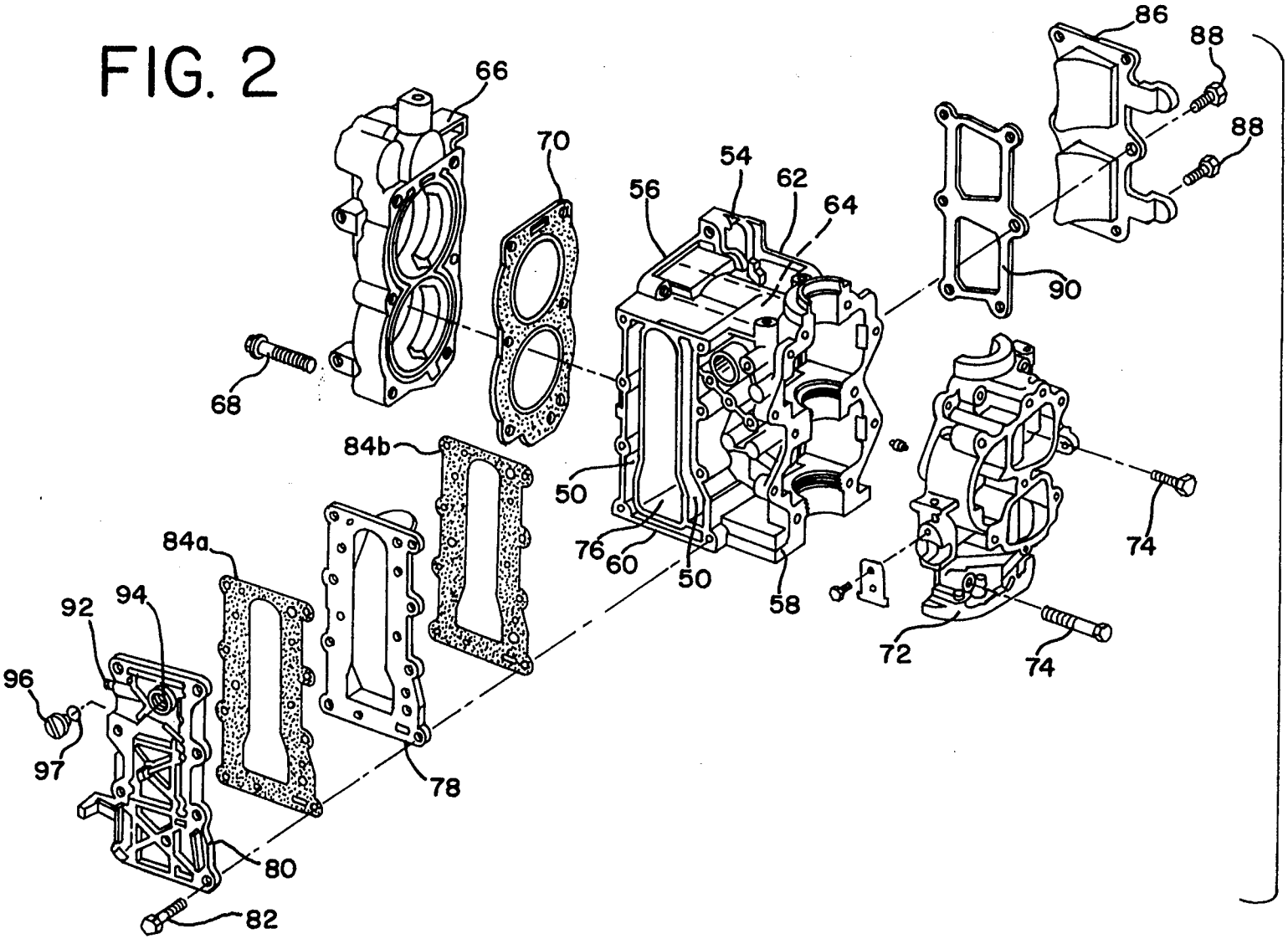
FIG. 2 is an exploded perspective elevational view of an outboard marine engine embodying the present invention, with parts omitted for clarity.

Referring now to FIGS. 2 and 3, the motor 10 includes an engine block 54 having an upper end 56, a lower end 58, a first side 60 and a second side 62, and is provided with at least one cylinder 64 (shown hidden) for operationally retaining at least one piston (not shown). Each cylinder 64 is surrounded at least partially by the cooling jacket 50. A cylinder head 66 is secured to the upper end 56 by a plurality of fasteners 68 with a cylinder head gasket 70 disposed therebetween. A crankcase 72 is secured to the lower end 58 by a plurality of fasteners 74.

The first and second sides 60, 62 of the engine block 54 each define an ambient opening 76 into the cooling jacket 50. The first side 60 includes an inner exhaust cover 78 and an outer exhaust cover 80 secured to each other and the side 60 by a plurality of threaded fasteners 82 with a pair of exhaust cover gaskets, **84*a*, 84*b*, sandwiched therebetween. On the second side 62, the ambient opening 76 is covered by a bypass cover 86 secured to the engine block 54 by a plurality of fasteners 88 with a gasket 90 sandwiched therebetween. The ambient openings 76 are housed by the covers 78, 80 and 86**.

The outer exhaust cover 80 includes an overboard water indicator port 92 in fluid communication with the cooling jacket 50 to emit through an indicator hose (not shown) a stream of cooling water indicating the operation of the water pump 44 while the engine 18 is running. Also located on the outer exhaust cover 80 is a flushing access port 94 in fluid communication with the cooling jacket 50 and which is threaded to receive a removable threaded plug 96. The plug 96 is basically a large headed screw equipped with a resilient washer 97 for sealing purposes. The engine 18, including the engine block 54 as well as the flushing access port 94, are enclosed by the motor covers 14 and 16.

Referring now to FIG. 3, the flushing system of the invention, generally designated 98, is shown in greater detail. The system 98 includes a flushing adapter 100 with a body 102 having an axial bore 104 through which the flushing fluid is passed into the cooling jacket 50. It is contemplated that the flushing fluid or coolant is tap water, however, other equivalent fluids are considered suitable. A first end 106 of the body 102 is threaded and dimensioned to releasably engage the flushing access port 94. Adjacent the first end 106 is a shank portion 108, which integrally joins the first end 106 to a generally centrally located grip portion 110. The gripping portion 110 is generally of larger diameter than the shank portion 108, and in the preferred embodiment, has a ribbed outer surface to facilitate gripping.

Opposite the first, threaded end 106 of the flushing adapter 100 is the second end 112. The second end 112 is provided with a multi-diametrical configuration to matingly and sealingly engage a first end 114 of a valve adapter 116. The second end 112 also includes a locking groove 118 dimensioned to accommodate biased locking lugs 120 (shown hidden) of the adapter 116. Flushing adapter 100 also includes a washer 122 located at the first end 106 to seal the adapter to the outer exhaust cover 80, and an O-ring 124 located in an O-ring groove 126 to seal the adapter to the valve adapter 116.

The principal component of the valve adapter 116 is a selector valve 128 located on a generally tubular body 130 for controlling the flow of flushing fluid into the cooling jacket 50. In the preferred embodiment, the valve 128 is of the ball or globe type, however the use of other conventional valves is contemplated. The valve 128 includes an actuator handle 132 with a radially projecting tab 134 which is movable in a track 136 defined by a boss formation 138. In FIG. 3, the valve 128 is shown in a totally open position. When the valve 128 is totally closed, the tab 134 contacts the opposite end of the track 136. The boss formation 138 projects generally normal to the axis of the body 130.

The body 130 also defines an axial throughbore 140 which is dimensioned and threaded at a second end 142 to accommodate an end of a conventional garden hose 144. In the preferred embodiment, the second end 142 has a female thread and is also provided with a plurality of spaced, parallel gripping ribs 146 for facilitating the attachment of the adapter 116 to the garden hose 144. One valve adapter 116 that has been shown to be effective is manufactured under the trademark NELSUN.

In order to disengage the valve adapter 116 from the flushing adapter 100, the first end 114 of the valve adapter is provided with at least one and preferably two locking actuator buttons 148. When pressed inwardly, the buttons 148 release the biasing force exerted by the locking lugs 120 in the groove 118 in a manner well known in the art.

In operation, when flushing of the motor 10 is desired, the upper motor cover 14 is removed, exposing the outer exhaust cover 80. The flushing access port plug 96 is then removed, and the first end 106 of the flushing adapter 100 is sealingly engaged in the access port 94. Next, the valve adapter 116 is threadably engaged upon the garden hose 144, the valve actuator 132 is placed in the closed position, and the valve adapter 116 is engaged upon the second end 112 of the flushing adaptor 100 as the operator depresses and releases the locking buttons 148.

One of the features of the present system is that the valve adapter 116 is rotatable relative to the flushing adapter 100. Thus, if the adapters 100, 116 are attached as a unit to the access port 94, the hose 144 may be easily coupled to the second end 142 with a minimum amount of twisting.

Water is supplied to the hose 144 by turning on the tap in a conventional manner. Upon opening the valve 128, water flows into the relatively small throughbore 104 of the flushing adapter 100 and results in a high pressure stream being injected through the port 94 and into the cooling jacket 50. A first portion of the water will pass through the cooling jacket 50, flow through the water pump 44 and out the water intake 46. A second portion of the flushing water will circulate through the cooling jacket 50 and through the cooling jackets of any additional cylinders (not shown). Subsequently, the second portion of the flushing water will flow partially out the overflow indicator port 92, and partially through the exhaust housing 20, and out the propeller hub outlet 150. Once the flushing process is completed, the operator merely closes the valve 128, removes the flushing adapter 100, replaces the plug 96, and replaces the upper motor cover 14.

It will be appreciated that a significant advantage of the present flushing system is that the operator can control the flow of water into the motor 10 at the motor, and need not make several trips back and forth from the tap to adjust the flow of water. Another major advantage of the present invention is that the motor can be flushed without being turned on, which provides a safety advantage, as well as a far quieter mode of operation compared to conventional flushing systems.

While a particular embodiment of the flushing system for an outboard motor of the invention has been shown and described, it will be appreciated by those skilled in the art that changes and modifications may be made thereto without departing from the invention in its broader aspects and as set forth in the following claims.

What is claimed is:

1. A flushing system for an outboard marine motor, including an engine provided with at least one cylinder at least partially surrounded by a cooling jacket, comprising:

an access port disposed on said engine and being in fluid communication with said cooling jacket;

flushing means being detachably engageable in said access port for permitting inflow of a flushing fluid into said cooling jacket;

valve means disposed on said flushing means for selectively controlling the inflow of flushing fluid into said cooling jacket at the engine and at the discretion of an operator;

said flushing means including a flushing adapter having an axial throughbore, a first end releasably engageable in said access port, a shank portion adjacent said first end, a gripping portion adjacent said shank portion, and a second end adjacent said gripping portion and configured to releasably engage said valve means; and said first end of said valve means is provided with releasable biased locking means for preventing axial disengagement of said valve means from said flushing adapator.

2. The system as defined in claim 1 wherein said valve means includes a generally tubular adapter having an axial throughbore, an externally mounted valve actuator, and a valve member connected to said actuator for selective control of said flushing fluid.

3. The system as defined in claim 2 wherein said valve means further includes a first end configured to releasably engage said second end of said flushing adapter, and a second end configured to releasably engage a common garden hose.

4. The system as defined in claim 2 wherein said adapter includes a threaded portion at said first end for threadably engaging said access port, said gripping portion located on said adapter between said first and second ends, and said second end includes a locking formation for engaging said locking means on said valve means.

5. The system as defined in claim 4 wherein said locking formation is an annular groove on said second end for accommodating radially biased locking tabs on said valve means.

6. An outboard marine engine, comprising:

an engine block configured with at least one cylinder, a crankcase disposed at a lower end of said block, and a cylinder head disposed at an upper end of said block;

said at least one cylinder being surrounded at least partially by a cooling jacket, said engine block having first and second sides, at least one of said sides defining at least one ambient opening into said cooling jacket;

housing means for enclosing said at least one ambient opening in said cooling jacket;

an access port disposed on said housing means and being in fluid communication with said cooling jacket;

a flushing adapter being detachably engageable in said access port for permitting inflow of fresh water into said cooling jacket; and valve means in fluid communication with said flushing adapter and connectable to a common garden hose for selectively controlling the inflow of said flushing fluid into said cooling jacket at said engine and at the discretion of an operator;

said flushing means including a flushing adapter having an axial throughbore, a first end releasably engageable in said access port, a shank portion adjacent said first end, a gripping portion adjacent said shank portion, and a second end adjacent said gripping portion and configured to releasably engage said valve means; and said first end of said valve means is provided with releasable biased locking means for preventing axial disengagement of said valve means from said flushing adaptor.

7. The engine as defined in claim 6 wherein said valve means includes a generally tubular adapter body having an axial throughbore, an externally mounted valve actuator, and a valve member connected to said actuator for selective control of the passage of said flushing fluid into said cooling jacket.

8. A flushing assembly for introducing a flow of flushing fluid into an outboard engine having an engine block provided with at least one cylinder surrounded at least partially by a cooling jacket, the engine block defining at least one ambient opening into the cooling jacket, a housing cover for enclosing the at least one ambient opening in the cooling jacket, and an access port disposed on the housing cover and being in communication with the cooling jacket, said flushing assembly comprising:

a flushing adapter including an adapter body having an axial throughbore, a first end releasably engageable in the access port, a shank portion adjacent said first end, a gripping portion adjacent said shank portion, and a second end adjacent said gripping portion; and valve means in fluid communication with said second end of said adapter body and being configured for selectively controlling the inflow of the flushing fluid into said cooling jacket at the engine and at the discretion of an operator;

said first end of said valve means is provided with releasable biased locking means for preventing axial disengagement of said valve means from said flushing adapter.

9. The flushing assembly as defined in claim 8 wherein said valve means includes a generally tubular adapter having an axial throughbore, an externally mounted valve actuator, and a valve member connected to said actuator for selective control of the flushing fluid.

10. The flushing assembly as defined in claim 8 wherein said adapter includes a threaded portion at said first end for threadably engaging said access port, said gripping portion located on said adapter between said first and second ends and said second end includes a locking formation for engaging said locking means on said valve means.

11. The flushing assembly as defined in claim 10 wherein said locking formation is an annular groove on said second end for accommodating biased locking tabs on said valve means.

12. The flushing assembly as defined in claim 8 wherein said valve means is axially rotatable relative to said flushing adapter.

13. An outboard marine motor, comprising:

a power head configured with at least one cylinder at least partially surrounded by a cooling jacket, said power head defining at least one ambient opening into said cooling jacket;

an access port disposed on said power head and being in fluid communication with said cooling jacket;

flushing means being detachably engageable in said access port for permitting inflow of a flushing fluid into said cooling jacket;

valve means disposed on said flushing means for selectively controlling the inflow of flushing fluid at said power head into said cooling jacket at the discretion of an operator;

said flushing means including a flushing adapter having an axial throughbore, a first end releasably engageable in said access port, a shank portion adjacent said first end, a gripping portion adjacent said shank portion, and a second end adjacent said gripping portion and configured to releasably engage said valve means;

a first end of said valve means is provided with releasable biased locking means for preventing axial disengagement of said valve means from said flushing adaptor; and motor cover means for removably covering said access port when said flushing means is detached from said access port.

14. The motor as defined in claim 13 wherein said motor cover means includes an upper motor cover and a lower motor cover configured to enclose said power head.

* * * * *